US008469483B2

(12) United States Patent
Pawlik et al.

(10) Patent No.: US 8,469,483 B2
(45) Date of Patent: Jun. 25, 2013

(54) METHOD FOR ADJUSTING A SENSOR RESPONSE

(75) Inventors: Thomas D. Pawlik, Rochester, NY (US); Thomas F. Powers, Webster, NY (US); Mark C. Rzadca, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 133 days.

(21) Appl. No.: 13/118,805

(22) Filed: May 31, 2011

(65) Prior Publication Data

US 2012/0306958 A1 Dec. 6, 2012

(51) Int. Cl.
*B41J 29/393* (2006.01)

(52) U.S. Cl.
USPC ..... 347/19; 347/14; 347/16; 347/101

(58) Field of Classification Search
USPC ..... 347/14, 16, 19, 101, 105–107
See application file for complete search history.

(56) References Cited

U.S. PATENT DOCUMENTS 6,713,775 B2 * 3/2004 Chelvayohan et al. .. 250/559.16

* cited by examiner

*Primary Examiner* — Juanita D Jackson
(74) *Attorney, Agent, or Firm* — Peyton C. Watkins

(57) ABSTRACT

A method for determining a variance of a sensor in inkjet printers comprising maintaining a printer carriage at a stationary position; illuminating a media patch of known characteristics with a light source that varies an intensity of the light between at least a first and second intensity, in which the second intensity is different from the first intensity; obtaining an amount of light transmitted through the media patch by measuring a signal from a photo-detector during the illumination; and comparing the amount of received light to stored target values to determine a variation of the sensor response for forming a correction factor; and using the correction factor to calibrate at least a first signal of the inkjet printer.

15 Claims, 12 Drawing Sheets

METHOD FOR ADJUSTING A SENSOR RESPONSE

CROSS REFERENCE TO RELATED APPLICATIONS

Reference is made to commonly assigned U.S. patent application Ser. No. 13/118,788 filed concurrently herewith by Thomas D. Pawlik et al., entitled "An Inkjet Printer Having Automated Calibration", and commonly assigned U.S. patent application Ser. No. 13/118,782 filed concurrently herewith by Thomas D. Pawlik et al., entitled "Method For Determining Variance Of Inkjet Sensor", the disclosures of which are herein incorporated by reference.

FIELD OF THE INVENTION

The present invention generally relates to inkjet printers having a sensor that illuminates a print media and receives transmitted light for determining print media type, and more particularly an apparatus for obtaining calibration data, if needed, for the sensor due to light intensity variations and calibration data for varying the light intensity due to the type of detected paper.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge, so that the printhead needs to be replaced when the ink is depleted, or the ink tank can be detachably mounted to the printhead so that only the ink tank itself needs to be replaced when the ink tank is depleted. Carriage mounted ink supplies typically contain only enough ink for up to about several hundred prints. This is because the total mass of the carriage needs be limited so that accelerations of the carriage at each end of the travel do not result in large forces that can shake the printer back and forth.

Pickup rollers are used to advance the media from its holding tray along a transport path towards a print zone beneath the carriage printer where the ink is projected onto the media. In the print zone, ink droplets are ejected onto the media according to corresponding printing data.

It is noted that consumers use a plurality of different types of media for printing in inkjet printers. Commonly assigned and pending U.S. patent application Ser. No. 12/959,461 uses a sensor having a light source and detector for detecting the type of media being used for printing. As with any light source, light intensity may vary slightly over time causing the resulting signal used for detecting the media type to correspondingly vary.

Although the currently used apparatuses and methods for detecting the media type are sufficient, there exists a need to detect such light variations using transmissive optics and to calibrate the photo-detector signal accordingly for permitting accurate detection of media type. Consequently, the present invention provides a method for detecting the light variation and providing a calibration signal.

SUMMARY OF THE INVENTION

The present invention is directed to overcoming one or more of the problems set forth above. Briefly summarized, according to one aspect of the invention, the invention resides in a method for determining a variance of a sensor in inkjet printers comprising maintaining a printer carriage at a stationary position; illuminating a media patch of known characteristics with a light source that varies an intensity of the light between at least a first and second intensity, in which the second intensity is different from the first intensity; obtaining an amount of light transmitted through the media patch by measuring a signal from a photo-detector during the illumination; and comparing the amount of received light to stored target values to determine a variation of the sensor response for forming a correction factor; and using the correction factor to calibrate at least a first signal of the inkjet printer.

In another embodiment, the present invention resides in a method for determining a variance of a sensor in inkjet printers comprising maintaining a printer carriage at a stationary position; illuminating a the print media with a light source that varies an intensity of the light between at least a first and second intensity, in which the second intensity is different from the first intensity; obtaining an amount of light transmitted through the media patch by measuring a signal from a photo-detector during the illumination; and comparing the amount of transmitted light to stored values to determine light transmittance of the paper and when a subsequent barcode scan is performed on the paper, the sensor response is correspondingly adjusted according to the amount of detected light.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Before discussing the present invention, it is useful to have a clear understanding of the terms used herein. As used herein, high and low intensity light pulses are defined as being on the high and low intensity side of a nominal light intensity In and given by the formula (In+ΔIn) for the high intensity light pulse and (In−ΔIn) for the low intensity light pulse, where ΔIn is preferably 0.1-10 percent although other ΔIn may also be used. It should be noted that although the term light is used herein, it is meant to also include electromagnetic radiation outside the visible spectrum.

Figure 1:
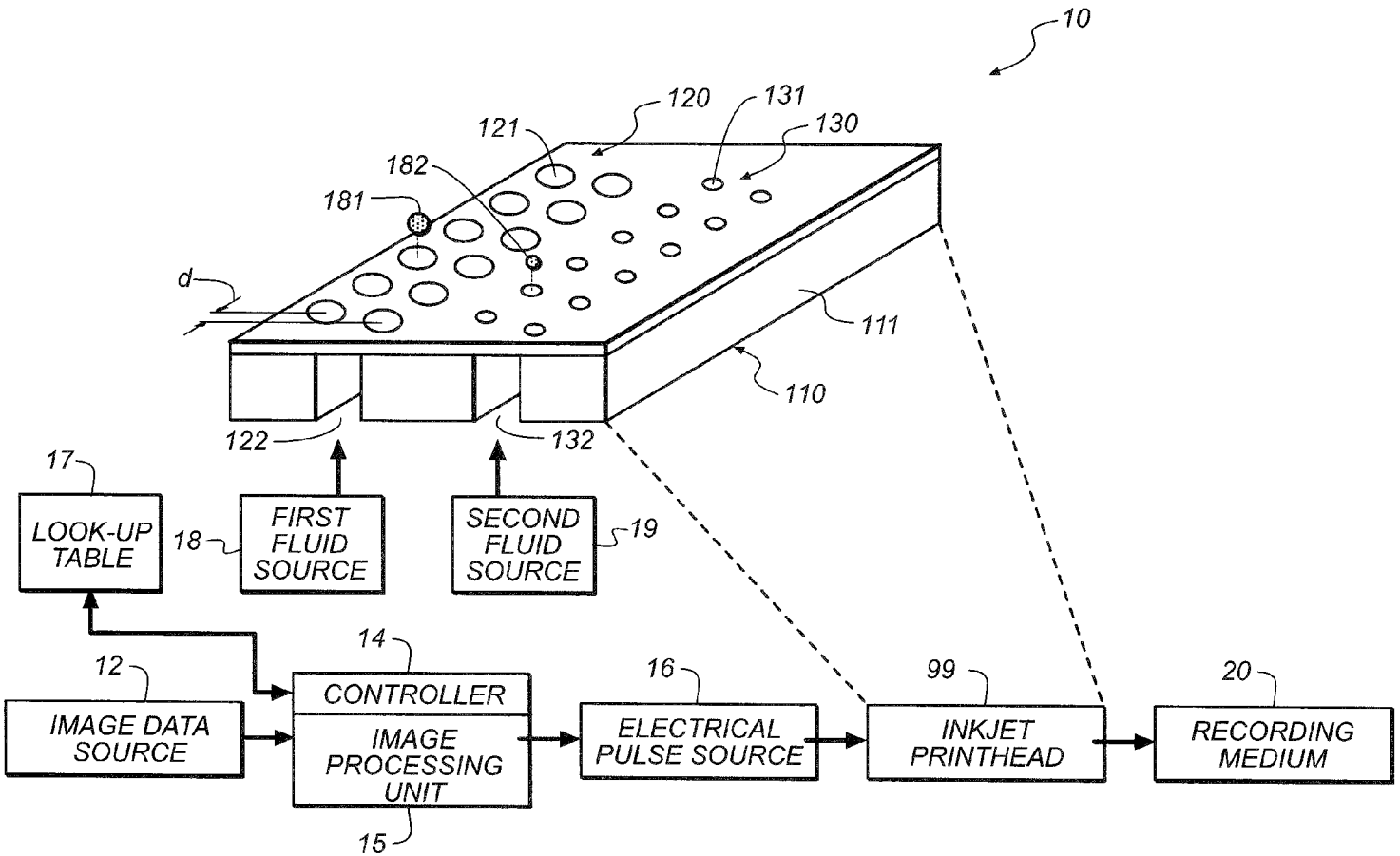
FIG. 1 is a schematic representation of an inkjet printer system.

Referring to FIG. 1, a schematic representation of an inkjet printer system 10 is shown for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and the controller 14 outputs signals to an electrical pulse source 16 of electrical energy pulses that are inputted to an inkjet printhead 99, which includes at least one inkjet printhead die 110. A look-up table 17 includes bi-directional communication with the controller 14 that is used in determining media type as described in U.S. Pat. No. 7,635,853 and will not be further discussed herein.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the media advance direction, the nozzles from one row of an array would print the odd numbered pixels, and the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 99, but for greater clarity only one inkjet printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
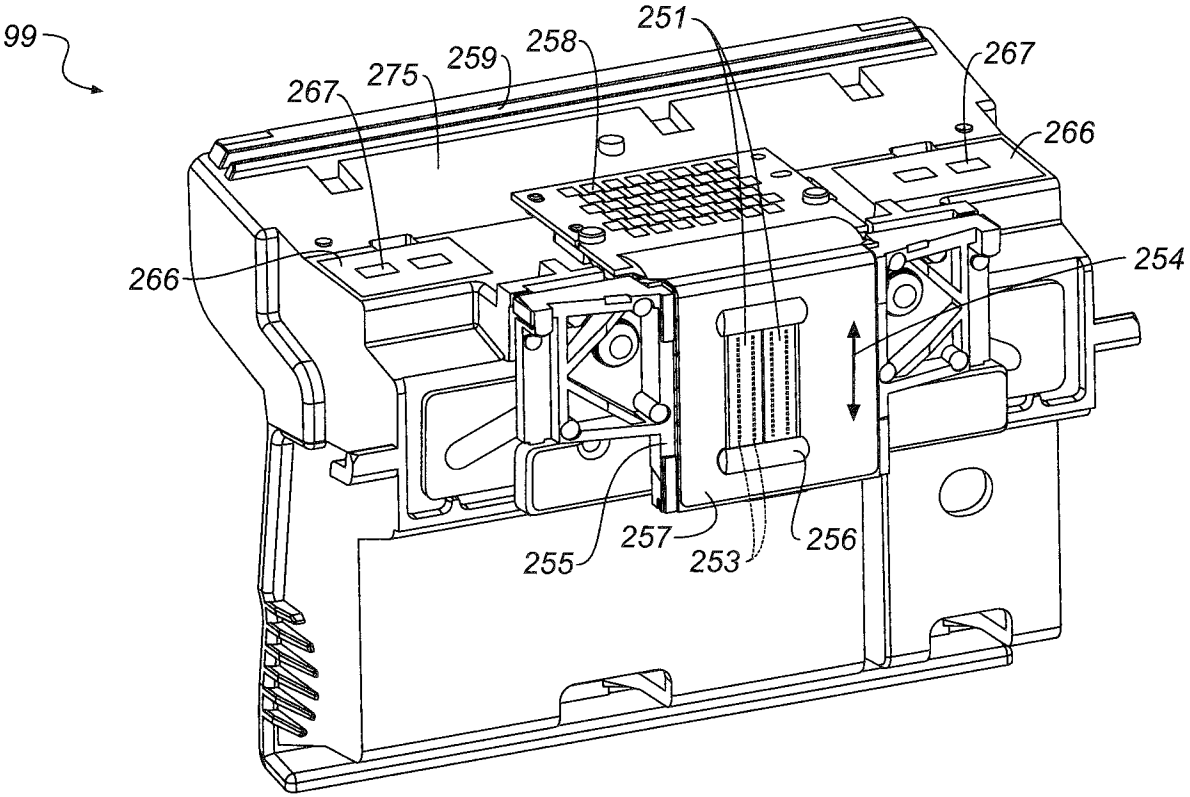
FIG. 2 is a perspective view of a portion of a printhead.

FIG. 2 shows a perspective view of the inkjet printhead 99 plus ink sources 18 and 19. Inkjet printhead 99 includes two printhead die 251 (similar to printhead die 110 in FIG. 1) that are affixed to mounting substrate 255. Each printhead die 251 contains two nozzle arrays 253 so that inkjet printhead 99 contains four nozzle arrays 253 altogether. The four nozzle arrays 253 in this example are each connected to ink sources (not shown in FIG. 2), such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for plain paper (8.5 by 11 inches). Thus, in order to print a full image, a number of swaths are successively printed while moving inkjet printhead 99 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of inkjet printhead 99 and connects to connector board 258 on rear wall 275. A lip 259 on rear wall 275 serves as a catch for latching inkjet printhead 99 into the carriage 200. When inkjet printhead 99 is mounted into the printhead carriage 200 (see FIG. 3), connector board 258 is electrically connected to a connector on the carriage 200 so that electrical signals can be transmitted to the printhead die 251. Inkjet printhead 99 also includes two devices 266 mounted on rear wall 275. When inkjet printhead 99 is properly installed into the carriage of a printhead carriage 200, electrical contacts 267 will make contact with an electrical connector on the carriage.

Figure 3:
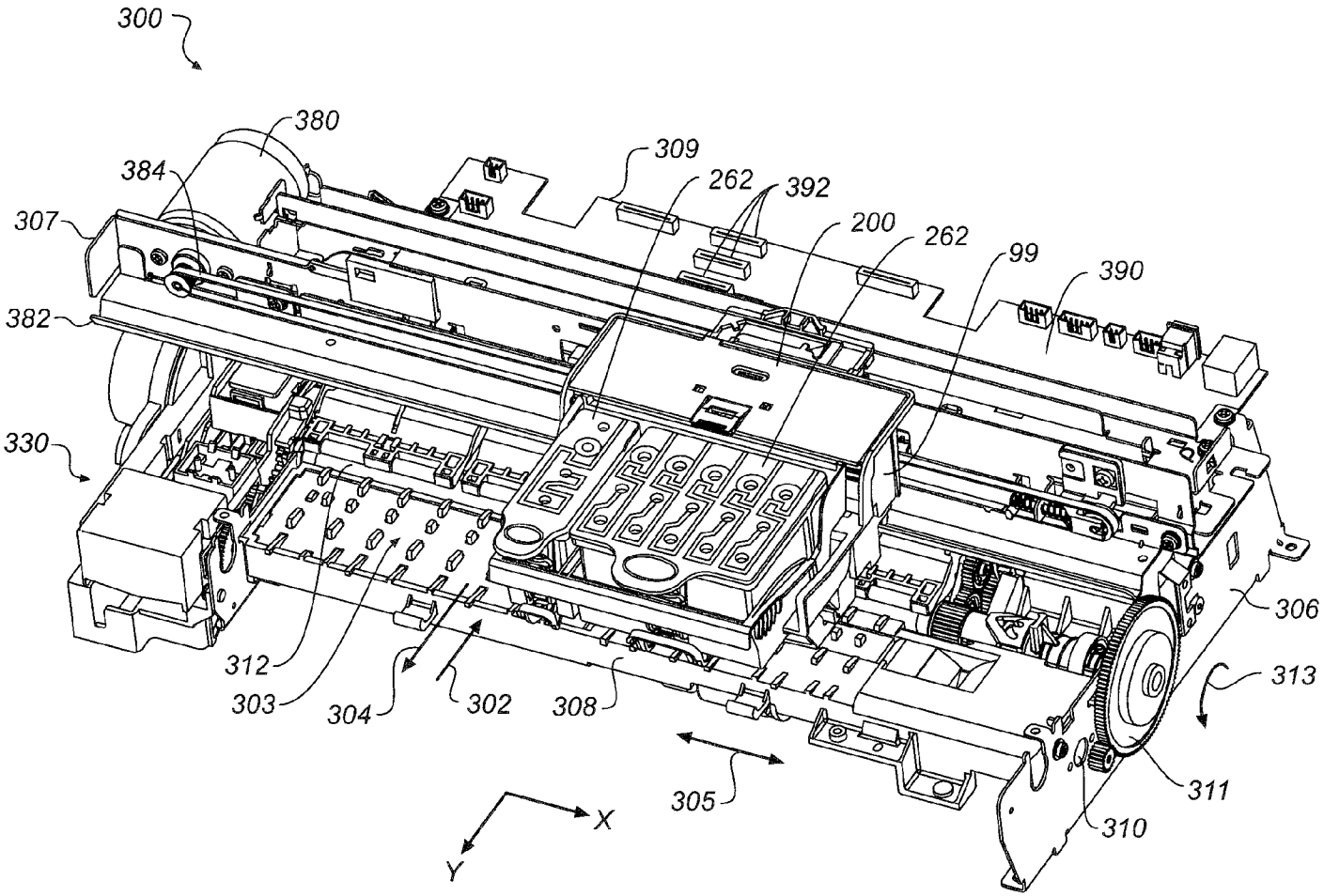
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which printhead carriage 200 is moved back and forth in carriage scan direction 305 between the right side 306 and the left side 307 of printer chassis 300, while drops are ejected from printhead die 251 (not shown in FIG. 3) on inkjet printhead 99 that is mounted on carriage 200. Carriage motor 380 moves belt 384 to move printhead carriage 200 along carriage guide rail 382.

The mounting orientation of inkjet printhead 99 is rotated relative to the view in FIG. 2, so that the printhead die 251 are located at the bottom side of inkjet printhead 99, the droplets of ink being ejected downward onto the recording medium in print region 303 in the view of FIG. 3. Cyan, magenta, yellow and black ink sources 262 are integrated into inkjet printhead 99. Paper or other recording medium (sometimes generically referred to as paper or media herein) is loaded along paper load entry direction 302 toward the front of printer chassis 308.

Figure 4:
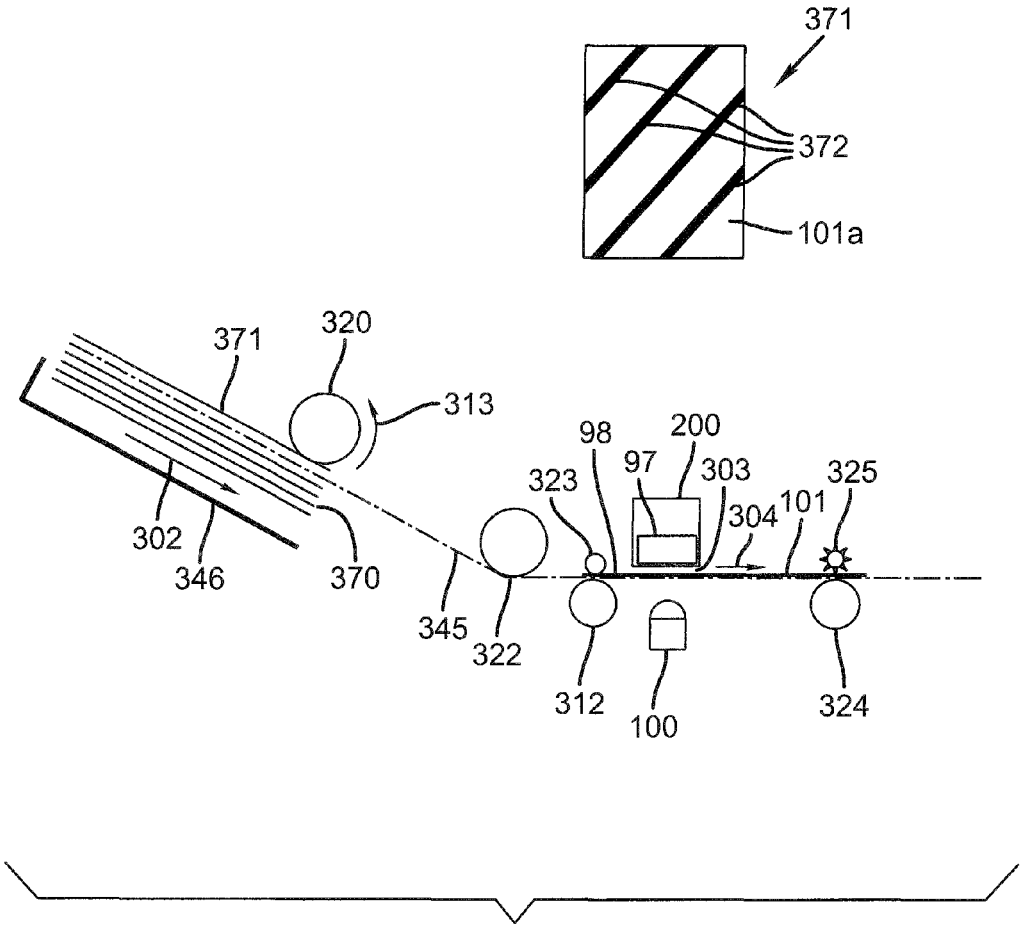
FIG. 4 is a schematic side view of a media path in a carriage printer of the present invention.

A variety of rollers are used to advance the medium through the media transport path 345 (indicated by the dot dash lines) of the printer as shown schematically in the side view of FIG. 4. It is noted that FIG. 4 illustrates a L-shaped configuration for paper entry, although other configurations are also usable with the present invention. A stack of media 370 is disposed in a media tray 346 for providing a print media. In this example, a pick-up roller 320 moves the top sheet of the media 371 (referred to as recording medium 20 in FIG. 1) in the direction of arrow, media load entry direction 302. A turn roller 322 acts to move the media around an angled path so that the media 371 continues to advance along media advance direction 304 from the rear 309 of the printer chassis (with reference also to FIG. 3). The media 371 is then moved by feed roller 312 and idler roller(s) 323 to advance across print region 303. From there, the media 371 advances to a discharge roller 324 and star wheel(s) 325 so that printed media exits along media advance direction 304.

The motor that powers the media advance rollers is not shown in FIG. 3, but the hole 310 at the printer chassis right-side 306 is where the motor gear (not shown) protrudes through in order to engage feed roller gear 311, as well as the gear for the discharge roller (not shown). For normal media pick-up and feeding, it is desired that all rollers rotate in forward rotation direction 313. Toward the printer chassis left-side 307, in the example of FIG. 3, is the maintenance station 330.

Toward the printer chassis rear 309, in this example, there is located the electronics board 390, which includes cable connectors 392 for communicating via cables (not shown) to the printhead carriage 200 and from there to the inkjet printhead 99. Also on the electronics board are typically mounted motor controllers for the carriage motor 380 and for the media advance motor, a processor and/or other control electronics (shown schematically as controller 14 and image processing unit 15 in FIG. 1) for controlling the printing process, and an optional connector for a cable to a host computer.

Referring back to FIG. 4, the printhead carriage 200 includes a transmittance sensor 97 having an aperture and a photo-detector, all of which are discussed hereinbelow. Movement of the printhead carriage 200 by the carriage motor 300 and belt 304 simultaneously moves the attached transmittance sensor 97 in a direction perpendicular to the media feed direction 304. A light source 100 is positioned opposing the printhead carriage 200 such that the light source illuminates the non-print side of the media 374 and an optional media patch 98, and transmitted light is captured by the transmittance sensor 97. Preferably, the light source emits infrared radiation although other wavelengths in the visible and ultraviolet range may be used.

The transmittance sensor 97 identifies the particular type of media 371 currently being used for printing by detecting a barcode 372 that is printed on the non-print side of the media. The sensor 97 detects the lines of the barcode 372 as an attenuation of light transmitted through the media emitted from a light source 100. It is noted that the printer 10 uses any of a plurality of media types for printing (matte, plain or glossy), and the printer 10 identifies the particular type of media being used so that corresponding printing adjustments can be made.

The optical components of the transmittance sensor 97 and light source 100 are subject to manufacturing tolerances, which necessitates an initial calibration. In addition, over time the light source 100 or photodetector may become degraded so that the corresponding signal from the transmittance sensor 97 varies from the signal present when the sensor was initially configured. The degradation can be due to aging of the optoelectronic components or deposition of ink spray. In addition to identifying the media type, the transmittance sensor 97 of the present invention is used to detect variations in the signal from the light source 100 and photo-detector system that may occur over time.

An optional media patch 98 of known characteristics (typically either matte or glossy) is placed in a location suitable for the light source 100 to optically illuminate the media patch 98 and for the transmittance sensor 97 to capture the transmitted light. For example, the transmittance sensor 97 may be located to the side of the printhead carriage 200 and the media patch 98 may be located in the print region 303 at a position slightly below the media plane such that it can be illuminated by the light source 100 prior to media pick-up and feeding to the print region 303 as shown in FIG. 4. Alternatively, the media patch 98 can be located in plane with the media but to either side of the print region 303, i.e., outside of the footprint of the media. This media patch 98 is used in certain embodiments to determine whether there is degradation of the transmittance senor 97 as described herein below.

Figure 5:
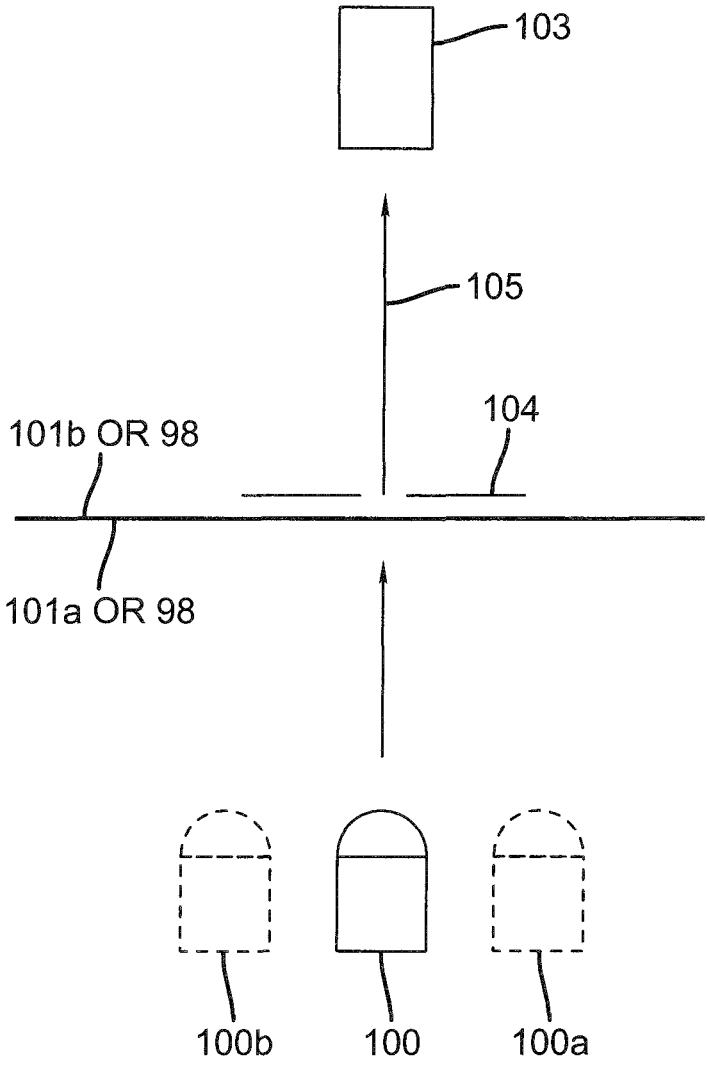
FIG. 5 is a block diagram illustrating the components of the print side transmittance sensor.

Referring to FIG. 5, there is shown an embodiment of the transmittance sensor 97. As the printhead carriage 200 is maintained in a stationary position, the illumination source 100, or optionally a plurality of illumination sources 100, 100*a*, 100*b*, emit a sequence of light pulses onto the non-print side of the media 101*a*, or alternatively onto the media patch 98. The detector 103 faces the print side of the media 101*b* and the light source 100, or light sources 100, 100*a* and 100*b*, faces the non-print side of the media 101*a*. Preferably a low intensity light pulse ($I_0-\Delta I_0$) is emitted first, immediately followed by a high intensity light pulse ($I_0+\Delta I_0$). This sequence is preferably repeated a number of times so that sufficient data points are collected although one sequence may also be used for time efficiency. The transmitted light 105 passes through an aperture 104 and is received by the photodetector 103. It is noted that the repeat frequency is chosen high enough such that the time variant signal is amplified by the AC-coupled amplifier. Preferably the repeat frequency is at or above the −3 dB point of the high pass filter circuit of the AC coupled amplifier. Although the present invention uses a low intensity light pulse followed by a high intensity light pulse, a high intensity pulse may be emitted first followed by a low intensity light pulse.

Figure 6:
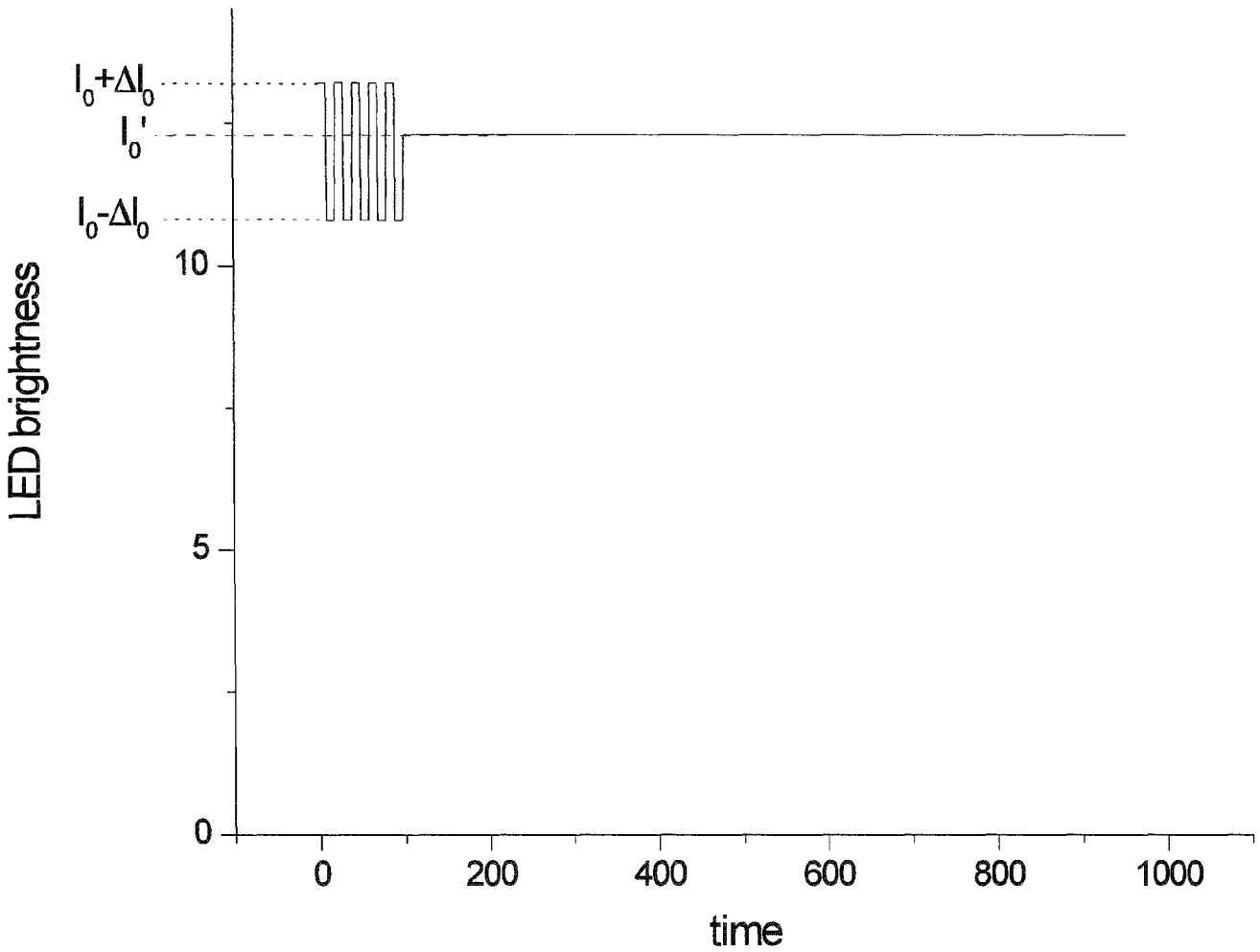
FIG. 6 shows a simulated trace of the time-varying intensity values of the illumination sources.

Referring to FIG. 6, each pulse sequence consists of alternating intensities of ($I_0+\Delta I_0$) and ($I_0-\Delta I_0$) for illumination source 100. These light pulses are detected by the photodetector 103. It should be obvious to a person skilled in the art that a light source intensity can be regulated by changing the current, or by changing the duty cycle using high frequency pulse width modulation. Although not preferred in this invention, light intensity modulation by a mechanical or photoelectric modulator is also possible.

A fraction of the illumination light that is transmitted through the media then passes through an aperture 104 (see FIG. 5). The photo-detector 103 detects light passing through the aperture 104. Photodetector 103 and aperture 104 are mechanically coupled to the printhead carriage 200. The signal from detector 103 is then used by the controller 14 to determine transmittance of the print media 101, or alternatively the media patch 98.

Following the detection of the light pulses, the illumination source 100 is set to emit constant light of the intensity $I_0'$ and the printer carriage 200 is moved across the media in the direction perpendicular to the media advance direction 304. During the printer carriage motion, the signal from the photodetector 103 is recorded by the controller 14.

Figure 7:
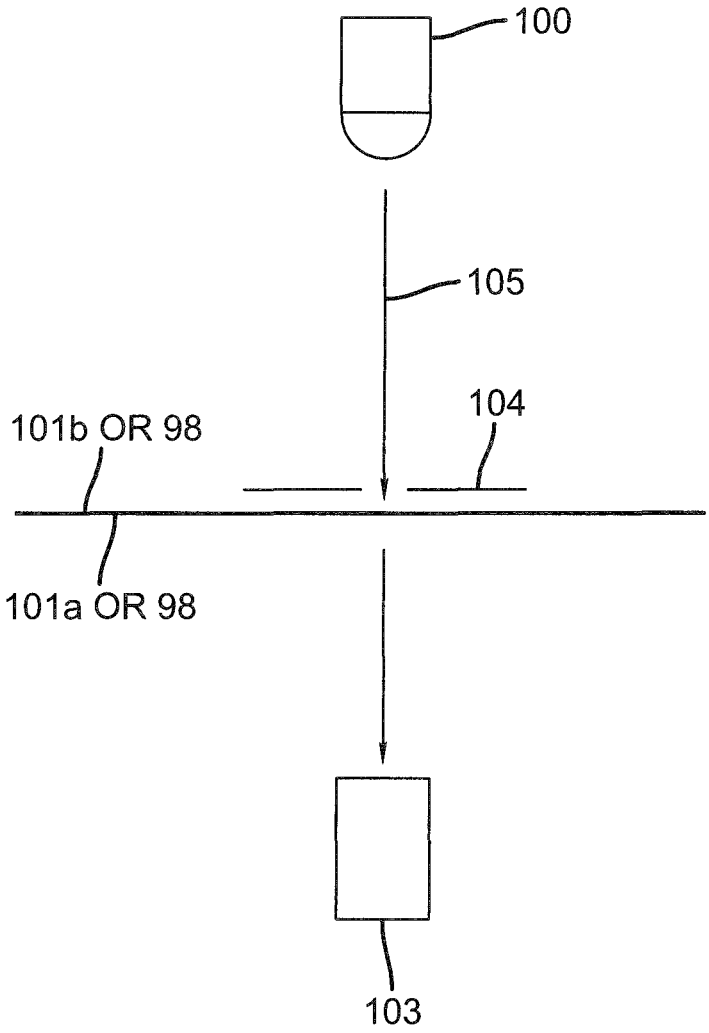
FIG. 7 is also a block diagram illustrating a second embodiment of FIG. 5.

Referring to FIG. 7, there is shown an alternative embodiment of the present invention. In this embodiment, the photodetector 103 is positioned such that it faces the non-print side of the media 101*a* or the media patch 98 and the light source 100 and aperture 104 are facing the print side of the media 101*b* or the opposite side of the media patch 98 and mechanically coupled to the printhead carriage 200. The illuminating light is confined by the aperture 104 and is incident on the print side of the media 101*b* or the media patch 98. The portion of the light that is transmitted through the media 371 is captured by the photodetector 103. As the printer carriage 200 is maintained in a stationary position, the illumination source emits a sequence of high and low light pulses onto the print side of the media 101*b* or media patch 98. Following the detection of the light pulses, the illumination source 100 emits a constant light of the intensity $I_0'$ while the printhead is simultaneously moved at a constant velocity across the media in the direction perpendicular to the media advance direction 304. During the printhead motion, the signal from the photodetector 103 is recorded by the controller 14.

Both sensor configurations in FIGS. 5 and 7 are able to measure transmittance of the media 101 or media patch 98 during the phase in which the illumination intensity is modulated and the printhead carriage 200 is not moving. They are further able to detect the lines of the barcode 372 that are printed on the non-print side of the media 101*a* as a time variant attenuation of the transmittance signal as the carriage is moved across the media surface at constant velocity.

Figure 8:
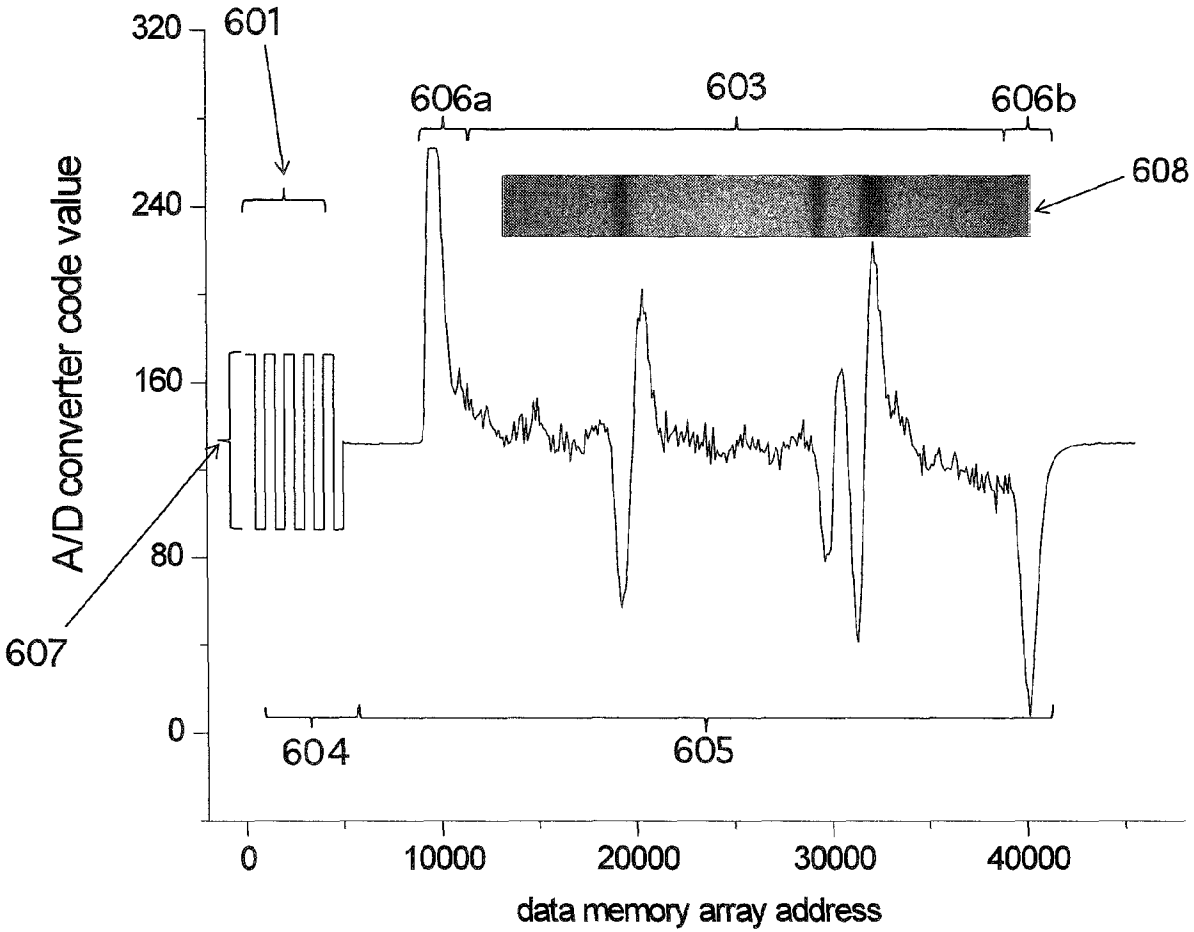
FIG. 8 shows a simulated trace from the sensor in FIG. 6 including the phases of transmittance measurement on a media patch and barcode scan on the print side of the media.
Figure 9:
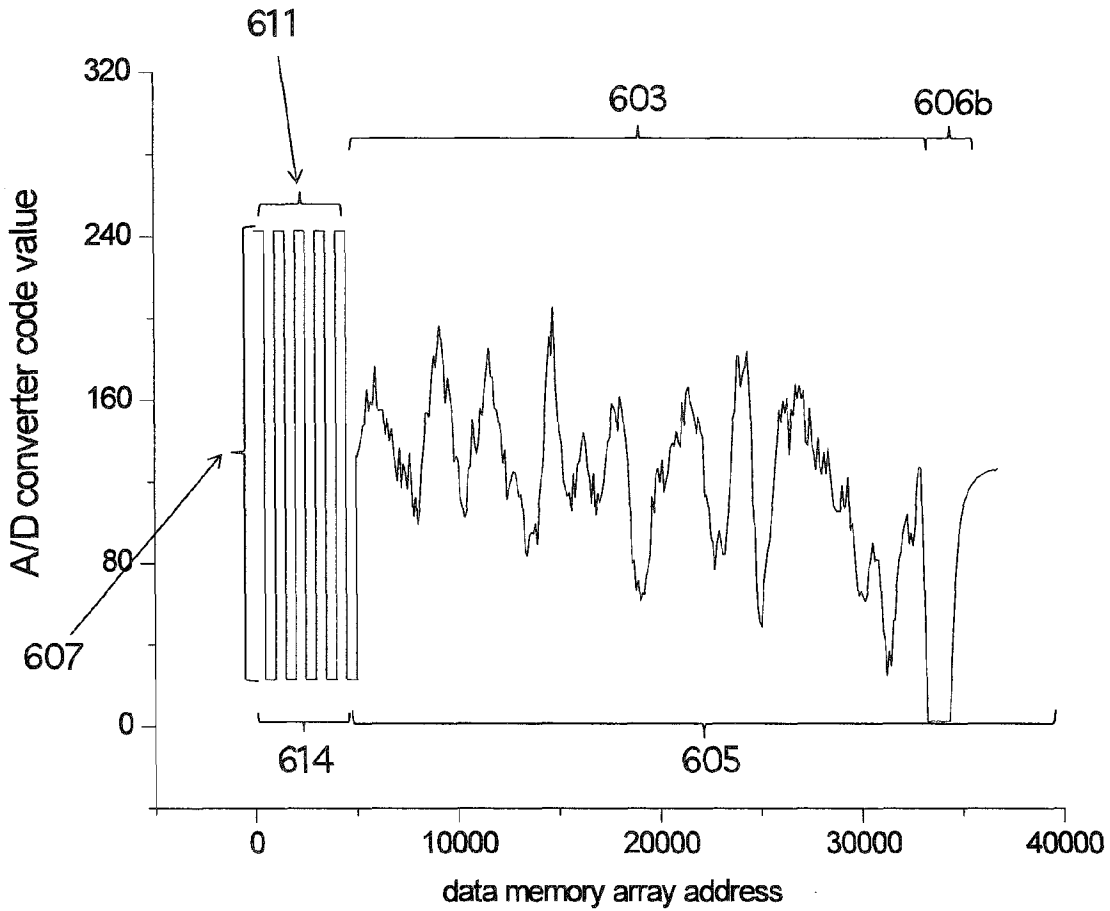
FIG. 9 shows a second embodiment of FIG. 8 where the transmittance measurement and barcode scan are both performed on the print side of the media.
Figure 10:
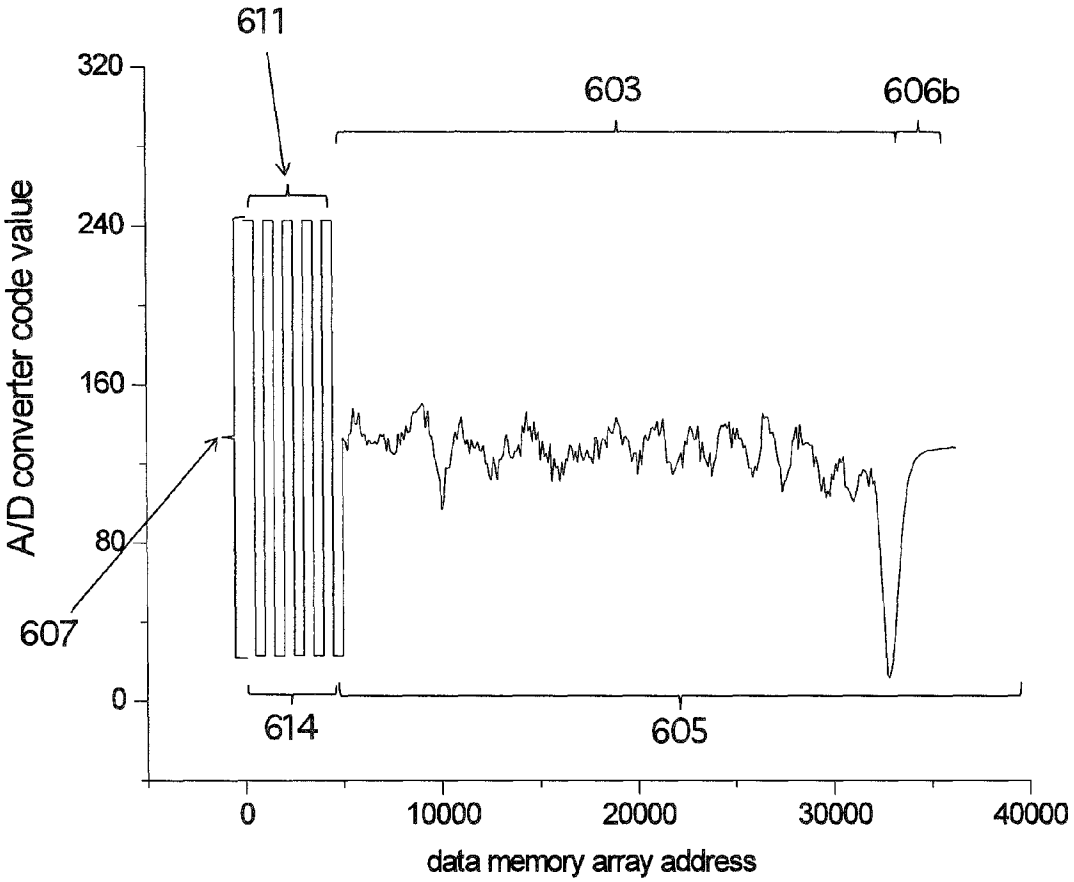
FIG. 10 shows a third embodiment of FIG. 8 where the transmittance measurement and barcode scan are both performed on the print side of the media and the sensor performance is attenuated or amplified according to the result of the transmittance measurement.

The following FIGS. 8 through 10 describe how this data collected by the photodetector 103 is used to improve robustness of media detection.

Referring to FIG. 8, there is shown simulated data from the photodetector 103 of transmittance sensor 97 described in FIG. 5 using the media patch 98. The signals from the photodetector 103 are processed through an analog to digital converter for producing a digital signal which is a more suitable form for analysis. While the printhead carriage 200 is stationary in phase 604, the signal is monitored and it produces a first distinct segment of data: region 601 is from modulated light transmitted through the media patch 98. The amplitude 607 of the transmittance signal (601) is compared by the controller 14 to stored target values for the media type identical to the media patch 98 which are stored in look-up table 17 (see FIG. 1). If the signal varies from the original signal target value, this indicates a degradation of the transmittance sensor 97, and the signal for identifying media type is then amplified or attenuated by the percent of the detected variance increase. If no difference is detected, the actual signal is used without any amplification or attenuation. Amplification or attenuation can be achieved by several methods. These include modification of the AC amplifier gain, adjustment of the light source intensity, mathematical processing of the digitized sensor signal or processing of the parameters derived from it by multiplication with a calibration factor. The result is a sensor signal that is compensated for degradation effects and represents a normalized sensor response.

The next region of the chart, 603, is the signal while the printhead encounters the leading edge of the media (phase 606*a*), moves across the media surface (phase 605) and eventually encounters the edge of the media in phase 606*b*. During the path of the printhead across the media the sensor 97 encounters several positions where the barcode lines 372 attenuate the detector signal. These lines are evident in the photodetector signal 603 as deviations from the mean photodetector signal. Image representative of a barcode pattern is shown as 608. Because of the AC-coupling of the amplifier, the typical line shape is a negative peak when the photodetector 103 moves onto the barcode line, immediately followed by a positive peak when the photodetector moves off the barcode line. The microcontroller 14 analyzes the recorded transmittance photodetector signal 603 after normalization and determines the position and strength of the barcode lines. By comparing these parameters with a matrix of stored values for the barcode properties of various media, the controller 14 can identify the media.

Referring to FIG. 9, there is shown simulated data from the detector described hereinabove in FIG. 5 using the print side of the media 101*a*. This data includes all the same descriptions as for FIG. 8, but it is noted that the transmittance signal 611 is obtained with the transmittance sensor 97 facing the print side of the media 101*a*. The photodetector signal 611 results from modulated light transmitted through the media 101. With the printhead carriage 200 stationary 614, the media loaded in the printer is plain paper. Because plain paper is more translucent than the thicker photo paper, proportionally more light reaches the photodetector 103. This is evident in the larger amplitude 607 of the photodetector signal 611. Subsequently the transmittance sensor 97 moves across the media surface (phase 605) and eventually encounters the edge of the media in phase 606*b*. Because more light reaches the photodetector 103, the signal in phase 605 also contains more noise. The noise originates mainly from the paper fiber microstructure in the media. This poses a problem for the barcode detection because the noise can be interpreted as barcode lines and consequently plain paper can be misidentified as barcoded photo media.

Referring now to FIG. 10, there is shown how this problem can be avoided using the present invention. FIG. 10 includes all the descriptions as in FIG. 8. In this figure, the amplitude 607 of the transmittance signal (611) is compared by the controller 14 to stored target values for a typical photo paper which are stored in look-up table 17 (see FIG. 1). In this case the measured amplitude 607 of signal 611 is substantially higher than expected for photo paper. From the deviation, a calibration factor is obtained to compensate for the amount of light transmitted for the particular paper type detected (plain or photo paper) and it is used to normalize sensor response. For example, if the quantity of detected light is put on a scale of 1 to 10, the calibration factor correspondingly varies the light intensity in ten increments so that a first paper type has a first intensity and a second paper type has a second intensity different from the first intensity. It is noted that a specific type of paper may have a variation in light transmission due to manufacturing tolerances and that this calibration factor will also vary to compensate for this variation. The following scan across the media surface 605 is conducted using the attenuated or amplified sensor response. As a consequence of the calibration, the noise amplitudes are substantially lower and the signal is not misidentified as barcode lines. The loaded media can be identified reliably as plain paper because no barcode lines are found and the magnitude of the calibration factor indicates a more translucent media than photo media. This scheme is also beneficial to normalize the sensor response for photo media of different thicknesses. The controller 14 selects an optimal print mode for the determined media type.

Figure 11:
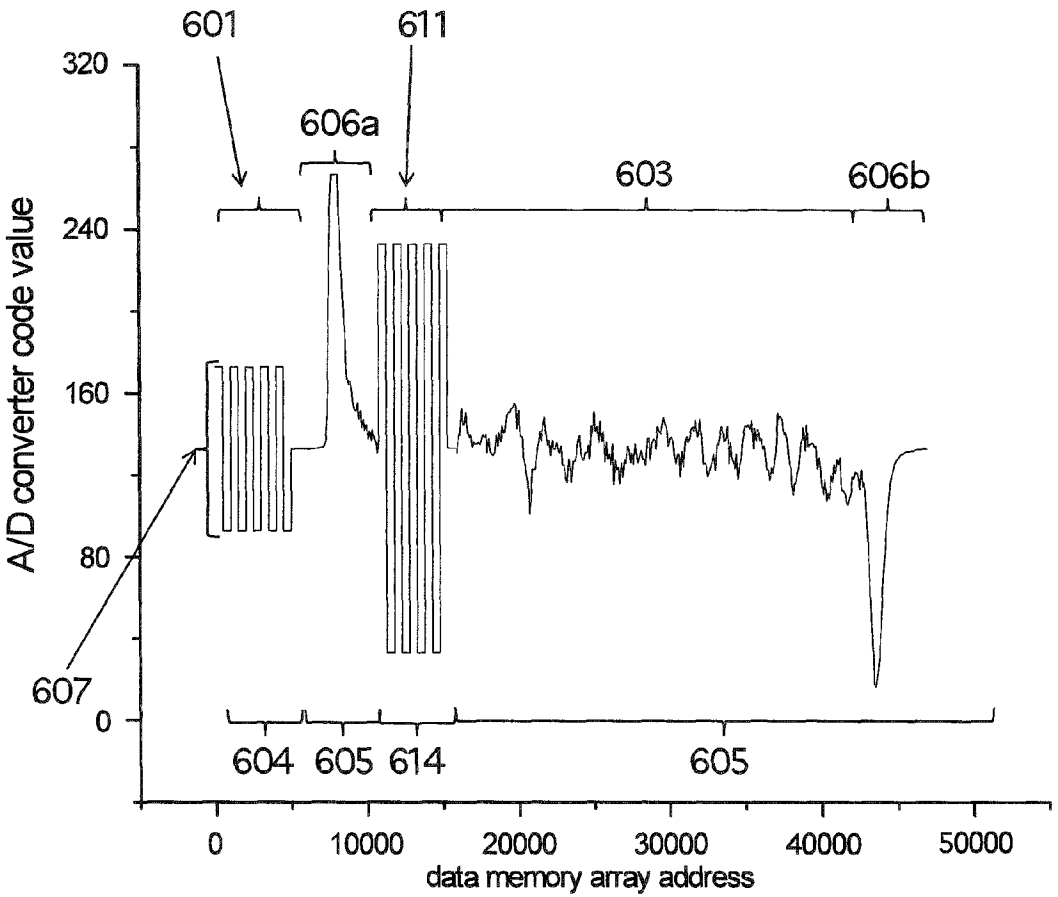
FIG. 11 shows a fourth embodiment of FIG. 8 where the transmittance measurement is performed on both the media patch and the print side of the media.

Referring to FIG. 11, there is shown a combination of the detection schemes of FIGS. 8 and 10. It is noted that items 600, 606*a*, and 606*b* are the same as previously described. During the time period when the printer carriage 200 is stationary 604 and the sensor is facing a surface of known transmittance such as media patch 98, light source 100 is pulsed using high and low intensity light pulses which creates transmittance signal 601. This signal is compared to stored values for the target of known transmittance. The variance is used to amplify or attenuate sensor response according to the process described in FIG. 8. This creates a calibrated sensor response. Subsequently, the printhead carriage 200 is moved 605 to a position where the transmittance sensor 97 faces the print side of the media 101*a*. During another stationary phase 614, the light source 100 is pulsed using high and low intensity light pulses which creates transmittance signal 611. The normalized sensor signal during phase 611 is compared to predicted values for glossy photopaper, matte photopaper and plain paper. This comparison yields a predicted first media type from the transmittance measurement. If signal 611 deviates from a predetermined value for photo media, the sensor response is attenuated or amplified accordingly for the subsequent barcode scan. In phase 605, the sensor is moved across the media surface and the sensor signal is recorded by the microcontroller 14. The second calibration ensures that the barcode scan is conducted with an optimized sensor response such that barcode lines 372 can be reliably identified. Like in FIG. 10, the absence of detected barcode lines and a large positive deviation of signal 611 from the predetermined value for photo paper are indicative of plain paper. The added benefit of the scheme in FIG. 11 is that degradation of the sensor can be compensated via the transmittance measurement of the media patch 98.

Figure 12:
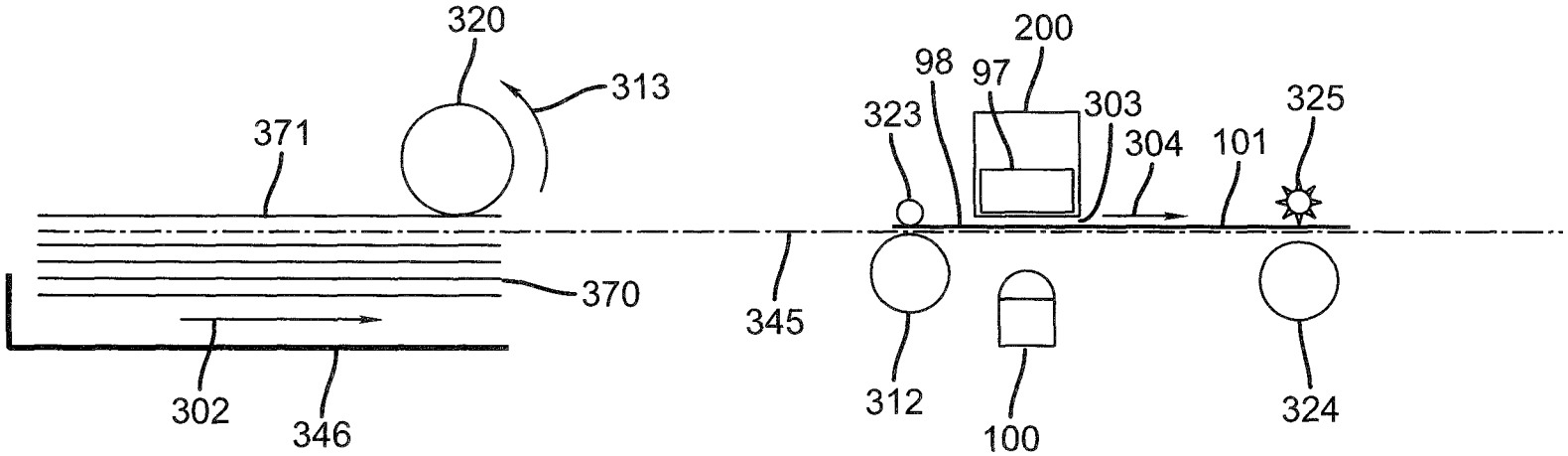
FIG. 12 is an alternative embodiment of FIG. 4.

FIG. 12 is an alternative embodiment of FIG. 4 having the roller 322 omitted and is generally referred to as a flat paper entry.

The invention has been described in detail with particular reference to certain preferred embodiments thereof, but it will be understood that variations and modifications can be effected within the spirit and scope of the invention.

PARTS LIST

| | |
|---|---|
| 10 | Inkjet printer system |
| 12 | Image data source |
| 14 | Controller |
| 15 | Image processing unit |
| 16 | Electrical pulse source |
| 17 | Look-up table |
| 18 | First ink source |
| 19 | Second ink source |
| 20 | Recording medium |
| 97 | Transmittance sensor |
| 98 | Media patch |
| 99 | Inkjet printhead |
| 100 | Illumination source |
| 100a | Illumination source |
| 100b | Illumination source |
| 101 | Media |
| 101a | Media, non-print side |
| 101b | Media, print side |
| 103 | Photodetector |
| 104 | Aperture |
| 105 | Transmitted radiation |
| 110 | Inkjet printhead die |
| 111 | Substrate |
| 120 | First nozzle array |
| 121 | Nozzle(s) |
| 122 | Ink delivery pathway (for first nozzle array) |
| 130 | Second nozzle array |
| 131 | Nozzle(s) |
| 132 | Ink delivery pathway (for second nozzle array) |
| 181 | Droplet(s) (ejected from first nozzle array) |
| 182 | Droplet(s) (ejected from second nozzle array) |
| 200 | Carriage |
| 251 | Printhead die |
| 253 | Nozzle array |
| 254 | Nozzle array direction |
| 255 | Mounting substrate |
| 256 | Encapsulant |
| 257 | Flex circuit |
| 258 | Connector board |
| 259 | Lip |
| 262 | Ink sources |
| 266 | Device |
| 267 | Electrical contact |
| 275 | Rear Wall |
| 300 | Printer chassis |
| 302 | Media load entry direction |
| 303 | Print region |
| 304 | Media advance direction |
| 305 | Carriage scan direction |
| 306 | Right side of printer chassis |
| 307 | Left side of printer chassis |
| 308 | Front of printer chassis |
| 309 | Rear of printer chassis |
| 310 | Hole (for media advance motor drive gear) |
| 311 | Feed roller gear |
| 312 | Feed roller |
| 313 | Forward rotation direction (of feed roller) |
| 320 | Pick-up roller |
| 322 | Turn roller |
| 323 | Idler roller |
| 324 | Discharge roller |
| 325 | Star wheel(s) |
| 330 | Maintenance station |
| 345 | Media transport path |
| 346 | Media tray |
| 370 | Stack of media |
| 371 | Media |
| 372 | Barcode |

-continued

| PARTS LIST | |
|---|---|
| 380 | Carriage motor |
| 382 | Carriage guide rail |
| 384 | Belt |
| 390 | Printer electronics board |
| 392 | Cable connectors |
| 601 | LED 100 is modulated between two brightness levels ($I_0 - \Delta I_0 \leftrightarrow I_0 + \Delta I_0$) for n periods. Sensor 97 is facing a target of known transmittance 98 |
| 603 | LED 100 is set at brightness I0' |
| 604 | Sensor is at a position facing a target of known transmittance 98 and not moving |
| 605 | Sensor is moving across the front side of the media at a constant velocity using carriage motion |
| 606a | Sensor in front of the media edge |
| 606b | Sensor is past the media edge |
| 607 | Amplitude of the sensor response to the modulation scheme 601 |
| 608 | Image representative of a barcode pattern |
| 611 | LED 100 is modulated between two brightness levels ($I_0 - \Delta I_0 \leftrightarrow I_0 + \Delta I_0$) for n periods. Sensor 97 is facing the print side of the media 101 |
| 614 | Sensor is at a position facing the print side of the media 101 and not moving |

The invention claimed is:

1. A method for determining a variance of a sensor in inkjet printers comprising:

maintaining a printer carriage at a stationary position;

illuminating a media patch of known characteristics with a light source that varies an intensity of the light between at least a first and second intensity, in which the second intensity is different from the first intensity;

obtaining an amount of light transmitted through the media patch by measuring a signal from a photo-detector during the illumination;

comparing the amount of received light to stored target values to determine a variation of the sensor response for forming a correction factor;

using the correction factor to calibrate at least a first signal of the inkjet printer; and using the calibrated signal to execute a barcode measurement of a print media.

2. The method as in claim 1 further comprising determining the media type by analyzing the barcode data.

3. The method as in claim 2 further comprising selecting an optimal print mode based on the identified media type.

4. A method for determining a variance of a sensor in inkjet printers comprising:

maintaining a printer carriage at a stationary position;

illuminating a print media with a light source that varies an intensity of the light between at least a first and second intensity, in which the second intensity is different from the first intensity;

obtaining an amount of light transmitted through the print media by measuring a signal from a photo-detector during the illumination; and comparing the amount of transmitted light to stored values to determine light transmittance of the print media;

adjusting a response of the sensor according to the amount of detected light; and moving the printer carriage to detect a barcode using the sensor with the adjusted response.

5. The method as in claim 4, wherein the adjustment of the sensor response is achieved by adjusting the light output of the light source.

6. The method as in claim 4, wherein the adjustment of the sensor response is achieved by adjusting the gain of the AC amplifier.

7. The method as in claim 4, wherein the sensor response is maintained at a first value for a first type of paper and maintained at a second value, which second value is different from the first value, for a second type of paper.

8. The method as in claim 4, wherein a media type is determined by analyzing both the barcode and the amount of transmitted light through the media.

9. The method as in claim 8 wherein an optimal print mode is selected for the determined media type.

10. A method for determining a variance of a sensor in inkjet printers comprising:

maintaining a printer carriage at a stationary position;

illuminating a media patch of known characteristics with a light source that varies an intensity of the light between at least a first and second intensity, in which the second intensity is different from the first intensity;

obtaining an amount of light transmitted through the media patch by measuring a signal from a photo-detector during the illumination;

comparing the amount of received light to stored target values to determine a variation of the sensor response for forming a correction factor; and using the correction factor to calibrate at least a first signal of the inkjet printer;

moving the printer carriage to a second stationary position in which the electronic device receives calibrated data indicating the amount of received transmitted light through a media from the light source; and comparing the amount of transmitted light to stored values to determine light transmittance of the media patch;

adjusting a response of the sensor according to the amount of detected light; and moving the printer carriage to detect a barcode using the sensor with the adjusted response.

11. The method as in claim 10, wherein the adjustment of the sensor response is achieved by adjusting the light output of the light source.

12. The method as in claim 10, wherein the adjustment of the sensor response is achieved by adjusting the gain of the AC amplifier.

13. The method as in claim 10, wherein the sensor response is maintained at a first value for a first type of paper and maintained at a second value, which second value is different from the first value, for a second type of paper.

14. The method as in claim 10, wherein a media type is determined by analyzing both the barcode and the amount of transmitted light through the media.

15. The method as in claim 14 wherein an optimal print mode is selected for the determined media type.

* * * * *